US006764644B2

(12) United States Patent
Dahlberg

(10) Patent No.: US 6,764,644 B2
(45) **Date of Patent: *Jul. 20, 2004**

(54) METHOD OF USING AN IMPACT MACHINE

(75) Inventor: Kurt Dahlberg, Karlskoga (SE)

(73) Assignee: Hydropulsor AB, Karlskoga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/973,986

(22) Filed: Oct. 11, 2001

(65) Prior Publication Data

US 2003/0007869 A1 Jan. 9, 2003

Related U.S. Application Data

(63) Continuation of application No. 09/779,449, filed on Feb. 9, 2001, which is a continuation-in-part of application No. 08/973,548, filed on Feb. 18, 1998, now Pat. No. 6,202,757.

(51) Int. Cl.[7] ..... B22B 3/00
(52) U.S. Cl. ..... 419/38; 72/362

(58) Field of Search ..... 419/38; 72/362

(56) References Cited

U.S. PATENT DOCUMENTS

| | | | | | |
|---|---|---|---|---|---|
| 3,135,140 | A | * | 6/1964 | Ottestad et al. | 100/269.14 |
| 3,205,790 | A | * | 9/1965 | Bollar | 72/19.9 |
| 3,271,991 | A | * | 9/1966 | Monahan | 72/407 |
| 4,840,236 | A | * | 6/1989 | Goldman | 173/206 |
| 5,392,865 | A | * | 2/1995 | Piras | 173/17 |

* cited by examiner

*Primary Examiner*—Ngoclan T. Mai
(74) *Attorney, Agent, or Firm*—Dennison, Schultz, Dougherty & MacDonald

(57) ABSTRACT

A method is disclosed for forming an article that includes the steps of filling a mold with a solid or particulate material, inserting a tool into the mold with a portion of the tool extending from the mold, and striking the tool with an impact ram to adiabatically coalesce the material in the mold to form an object having the shape of the mold. An apparatus for performing the method is also disclosed.

18 Claims, 9 Drawing Sheets

FIG. 1
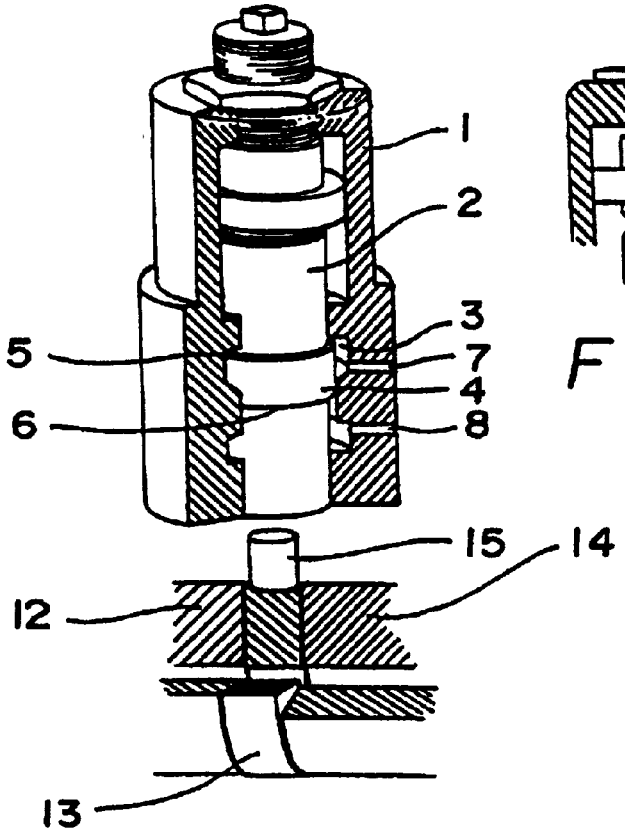
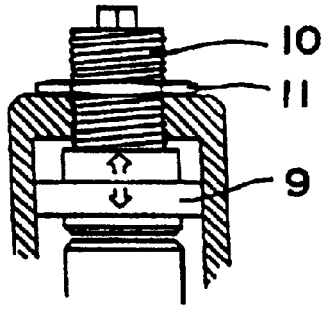
FIG. 2
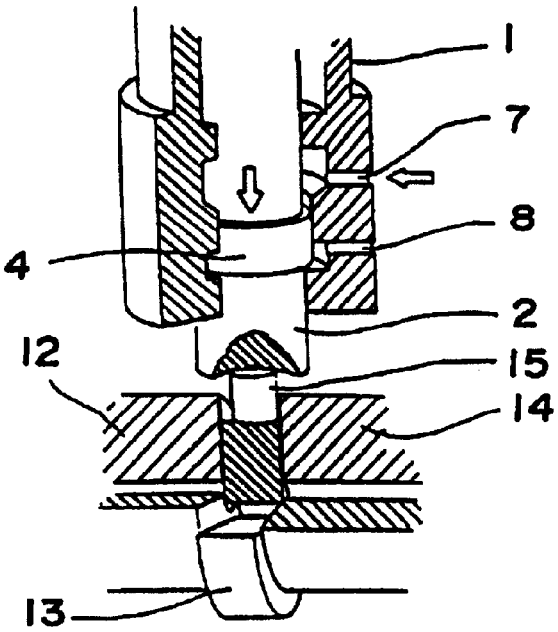
FIG. 3

METHOD OF USING AN IMPACT MACHINE

This application is a continuation of application Ser. No. 09/779,449 filed Feb. 9, 2001, which in turn is a continuation-in-part of application Ser. No. 08/973,548 filed Feb. 18 1998, now U.S. Pat. No. 6,202,757.

BACKGROUND OF THE INVENTION

The present invention relates to percussion machines. Such machines are known and feature a striking body that uses kinetic energy to strike an object. Such a striking body may, in known manner, be driven by a spring system or by means of compressed air. The supply of kinetic energy upon a stroke may be so great that the object is subjected to adiabatic coalescence which entails extremely efficient machining of the material subjected to striking. The machining occurs without loss of material and substantially avoids the occurrence of burrs, cracks or changes in the material.

When adiabatic coalescence occurs in connection with cutting, the kinetic energy transmitted should have a value of between 100 and 200 $Nm/cm^2$ cutting area. To achieve such kinetic energy the striking body should have a velocity of between 3 and 10 m/s upon impact. A percussion machine for cutting metal rods is particularly advantageous and in that case a hollow tool is used which is movable in relation to a supply hole. A percussion machine utilizing compressed air allows some 200 units/minute to be cut. On the other hand, if a spring-actuated percussion machine is used, some 400 units can be cut per minute.

The use of compressed air causes delays in the sequence control and high running costs. If a spring-actuated percussion machine is used it will be complicated and will give rise to long setting times and poor flexibility when integrating it with other machines. It is therefore desirable to develop a percussion machine with a simple running function, easy to manipulate and also easy to combine with other cooperating units.

SUMMARY OF THE INVENTION

The drawbacks mentioned above are eliminated by the present invention by changing over to utilizing hydraulics throughout. For this purpose a housing is used comprising a striking body which is moved hydraulically between two end positions. Purely hydraulically the striking body can be given such movement that, upon impact with the material encountered, it emits sufficient energy at sufficient speed for adiabatic coalescence to be achieved. The triggering stroke should be carried out quickly and a suitable time for the process is between 5 and 15 milliseconds. This short time is made possible thanks to the feasibility of removing the pressure fluid countering the stroke extremely quickly. Thanks to this rapid removal of the counter-pressing fluid, the percussion machine according to the present invention can achieve 3000 strokes/minute.

The striking body has two annular circumferential surfaces perpendicular to the axis of the body. The surface which, by means of liquid pressure, is to hold the striking body in its starting position is larger than the surface which, with the help of hydraulic pressure, is to effect a stroke movement. The pressure fluid is suitably supplied via a hydro-pneumatic accumulator.

Upon a stroke the pressure fluid that is endeavouring to keep the striking body in its initial position is emptied with the aid of a quick-acting valve system in which the movement of the body surrounding the valve is accelerated before opening the outlet valve. The opening area gradient is thus high and rapid emptying is obtained.

According to the invention two equivalent valve systems are used, constituting a valve housing comprising a cylindrical through-hole for two sealing cylinders arranged one after the other and joined by a connecting rod. Three annular recesses are also arranged one after the other, spaced from each other, the two outer annular recesses cooperating each with its own valve cylinder. All three annular grooves are connected, each by its own pipe, to a pressure fluid source. The unit with the two pressure cylinders can assume two outermost positions. In one position one of the outer annular grooves is open position to the valve body, while the other annular groove is in closed state. One valve system is used to control the supply of pressure fluid to the impact ram, in which case its cylinders are influenced by the pressure fluid coming from the other valve system, in which it is the two outer peripheral grooves that provide the latter cylinders with pressure fluid for their displacement. The rams in the other pressure system are influenced by two electromagnets operating alternately. The electromagnets are influenced by a switch and through the function of the switch the impact rams can be caused to perform a number of strokes per time unit. The strokes may occur continually or various intervals may be inserted between strokes, thereby offering wide variation with regard to the strokes.

The percussion machine has also proved suitable for shaping components such as spheres. A tool divided into two parts is used for this purpose, the parts forming a spherical space when put together, and having a connecting tube for the supply of material such as a metal powder which has preferably been gas-atomized, and for controlling a punch to which strokes can be transmitted from the percussion machine.

According to an advantageous embodiment of the invention the striking body may be hollow and contain a second striking body, movable between the ends of the cavity. The inner striking body is influenced by means of a pressure fluid in the same manner as the surrounding impact ram. Since the impact ram consists of two units, movable in relation to each other, the nature of the stroke can be varied within wide limits. According to an advantageous embodiment the inner striking body performs a follow-up stroke in relation to the outer striking body.

It is an advantage if the striking body cooperates either directly or indirectly with a damping ram, said ram most preferably cooperating with an oil layer that achieves the damping effect.

Said damping ram may suitably be caused to cooperate with a unit for regulating the stroke length of the tool. According to the invention this is achieved by the damping ram being brought to different positions, corresponding to the desired cutting length.

BRIEF DESCRIPTION OF THE DRAWINGS

The present invention will be described in more detail with reference to the accompanying nine sheets of drawings in which FIG. 1 shows a housing with impact ram and tool, arrangement for cutting metal rods, FIG. 2 shows an arrangement for regulating the stroke length of the impact ram, FIG. 3 shows part of an arrangement according to FIG. 1 during a stroke.

DESCRIPTION OF THE PREFERRED EMBODIMENTS

Figure 4:
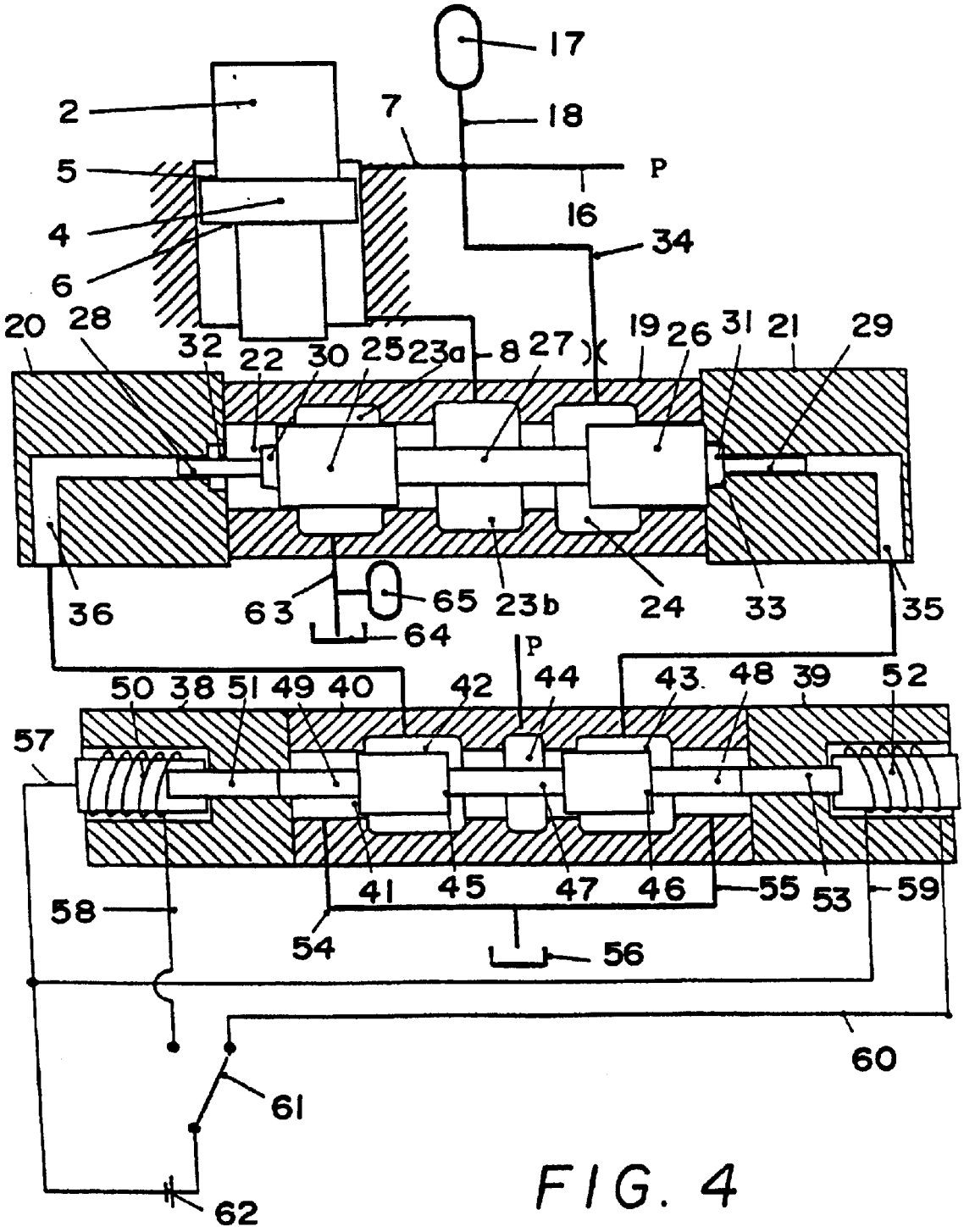
FIG. 4 shows a general diagram of a percussion machine.

In the drawings 1 is a housing containing an impact ram 2 movable between two end positions with the aid of a surrounding band 4 with two horizontal surfaces 5 and 6 designed to be influenced by a pressure fluid. 7 is an inlet for pressure fluid and 8 is both inlet and outlet for pressure fluid. Above the impact ram is a means 9 for regulating the stroke length with the aid of a vertically movable, threaded rod 10. The rod is locked in position by means of an adjustable nut 11. Said stroke-length regulator 9 may be so designed that the manual adjustment may be replaced with suitable automatic means. Below the impact ram 2 is a two-piece tool 12, 13 for rods. 12 is a fixed cutting tool, provided with a hole for rods. The cutting tool 13 is provided with a plug 15 which may be completely separate from the tool and is intended to transmit strokes from the impact ram to the movable tool 13. To the right of the tool 13 is a unit for carrying away cut metal units.

Figure 5:
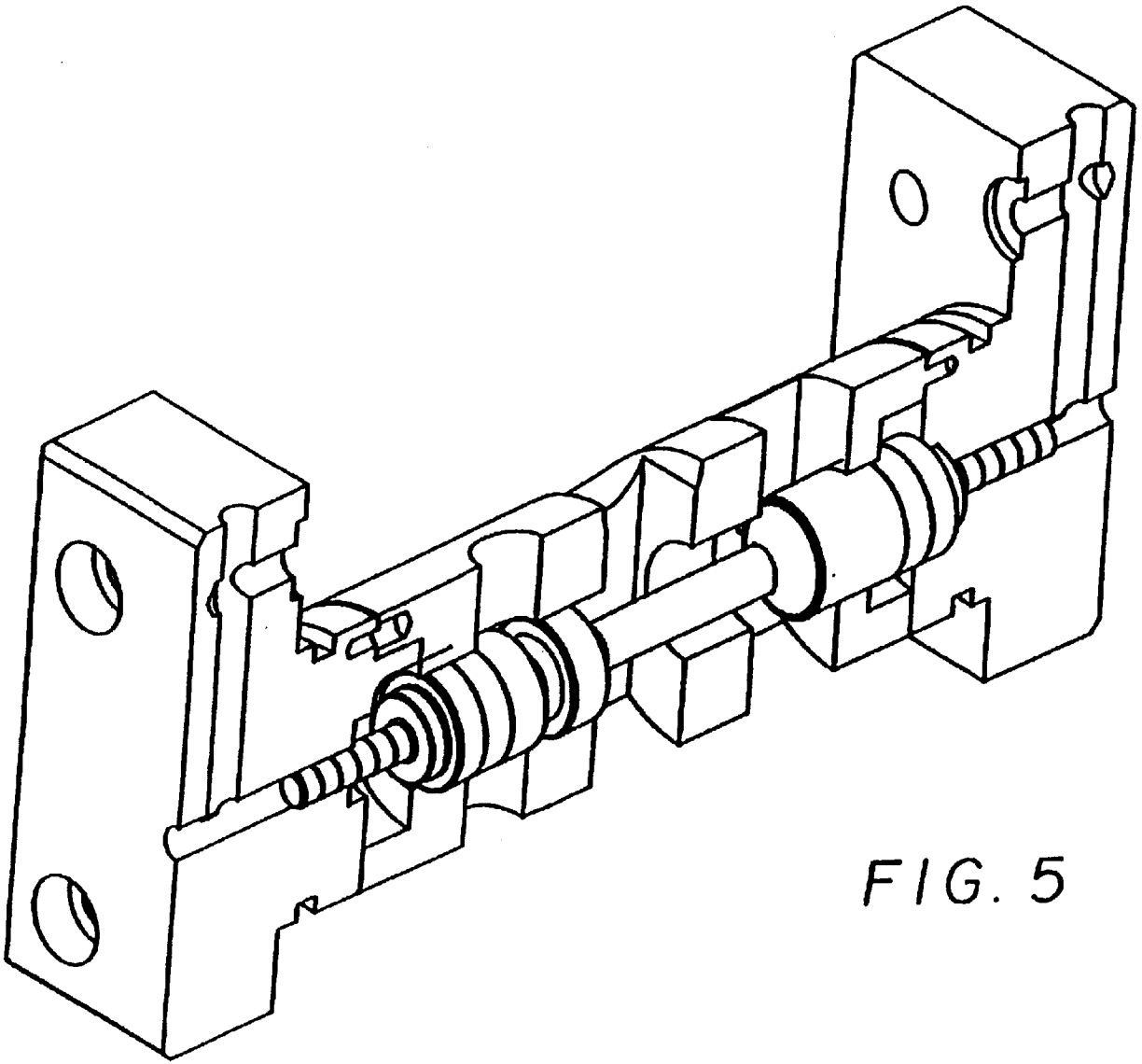
FIG. 5 shows a perspective view of a first valve system.
Figure 6:
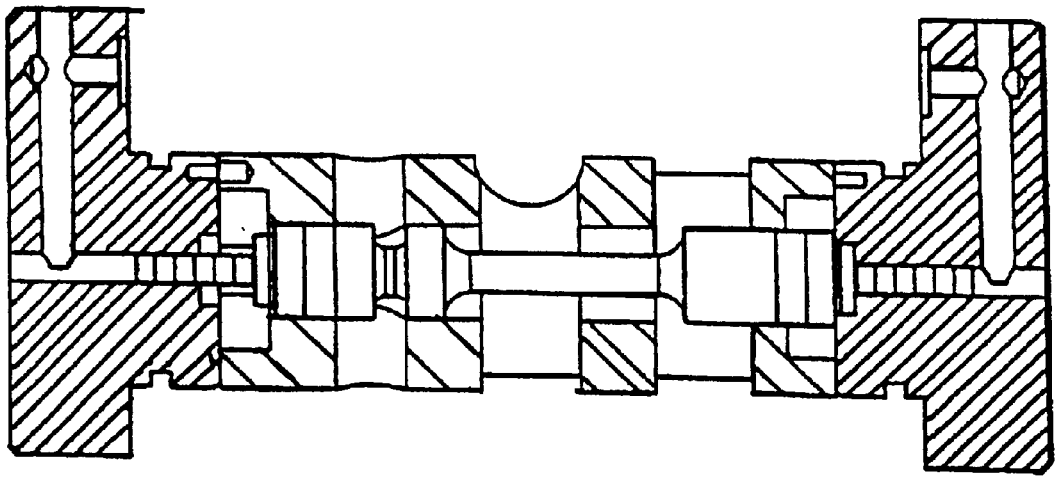
FIGS. 6–7 shows a cross section of the valve system shown in FIG. 5 in two different operating situations.
Figure 7:
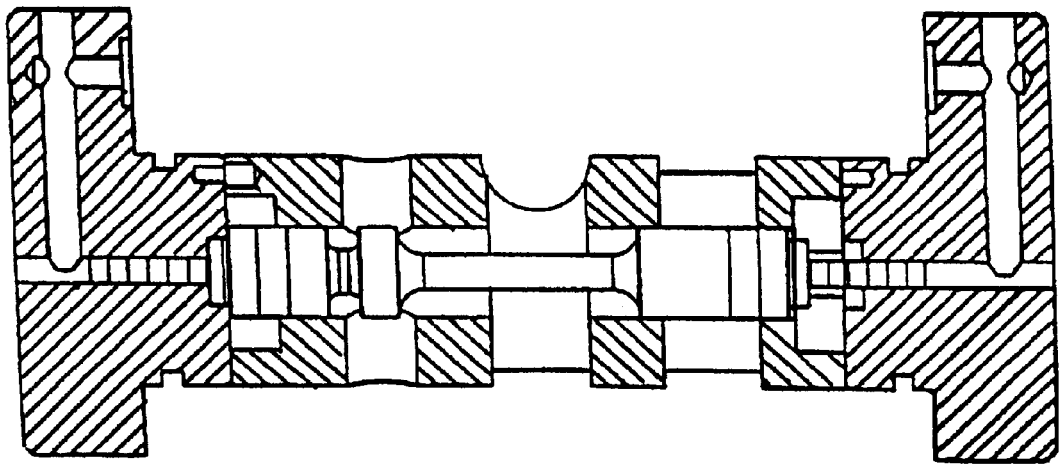
Figure 8:
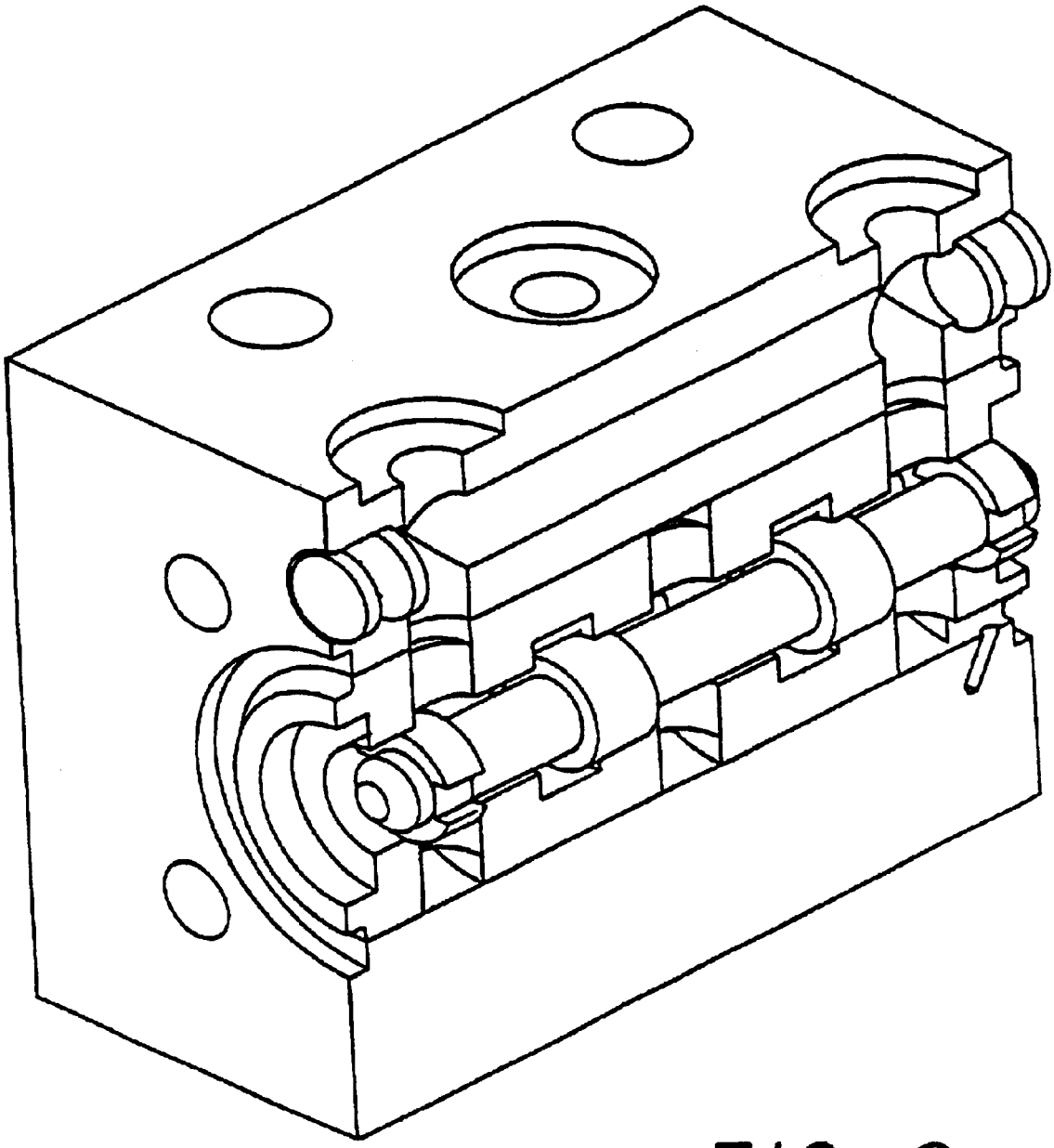
FIG. 8 shows a perspective view of a second valve system.
Figure 9:
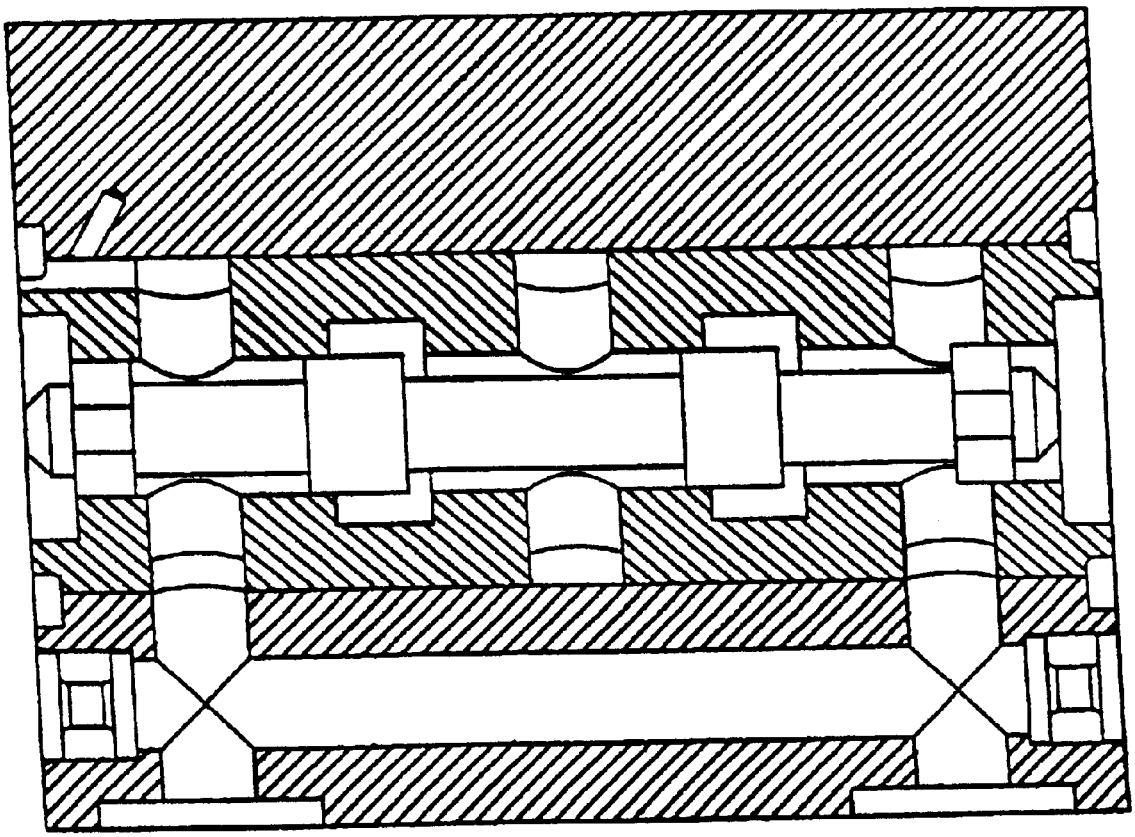
FIG. 9 shows a cross section of the valve system shown in FIG. 8 in one functioning position.

The percussion machine is supplied with pressure fluid from a pump through a pipe 16. Said pressure fluid is supplied to the housing 1 via the passage 7. The oil from the pipe 16 also communicates via the pipe 18 with a hydro-pneumatic accumulator 17. The upper contact surface 5 is thus constantly under pressure. The connection 8, communicating with the lower contact surface 6 for the pressure fluid, is connected to a first valve system consisting of a valve housing 19 with a left-hand end portion 20 and right-hand end portion 21. The valve housing 19 has a cylindrical through-hole 22 containing two valve bodies 25 and 26 arranged movable between two end positions. Both the valve bodies 25 and 26 are joined to a connection piece 27 so that the two valve bodies form a single unit. Said unit has two conically formed units 30 and 31 designed to cooperate with recesses 32 and 33. The cylindrical cavity 22 has three peripheral grooves 23*a*, 23*b* and 24. The recesses 23*a* and 24 have a width slightly less than the length of the valve bodies 25 and 26 with which they shall cooperate. Grooves and valve bodies shall form two valves. The space where the lower contact surface 6 is located can be connected by the connection 8 either to the groove 23*a* which is an outlet connection, or to the peripheral groove 24 which is under liquid pressure. The peripheral groove 23*a* is connected by a pipe 63 to a pressure fluid container 64 and also to a hydro-pneumatic accumulator 65. The unit with the valve bodies 25 and 26 can be moved from right to left and vice versa, and the units 30 and 31 are intended as damping means, their entry into the recesses 32 and 33 filled with pressure fluid thus having a damping effect The units 30 and 31 are provided with rods 28 and 29 acting as rams. These are supplied with pressure fluid via the connections 35 and 36, which moves the unit with the rams 25 and 26 to either the right or the left FIG. 5 shows a perspective view of how the system is constructed in practice. FIGS. 6 and 7 show the two operating positions the system can assume. Pressure fluid for the last-mentioned movement is obtained from a second valve system consisting of a central part 40, a left-hand part 38 with a first electromagnet 50 and a right-hand part 39 with a second electromagnetic 52, two peripheral grooves 42 and 43 and an intermediate peripheral groove 44. The peripheral grooves 42 and 43 are connected to the connections 35 and 36. The valve system also comprises two valve bodies 45 and 46 connected by an intermediate portion 47. The valve bodies 45 and 46 are provided at each end with protruding rods 48 and 49. These rods constitute contact members for movable rods 51 and 53 included in the two electromagnets 50 and 52. Voltage is supplied to the two electromagnets via wires 57, 58 and 59, 60 from a voltage source 62. The supply of voltage to the two electromagnets 50 and 52 is regulated by a switch 61. The cylindrical cavity 41 is connected via pipes 54 and 55 to a fluid container 56. FIG. 8 shows a practical embodiment of the second valve system in perspective and FIG. 9 shows said valve system in section in a working position.

Thanks to the switching member 61, the valves 45, 46, 47, 48 and 49 can move either to the right or the left. The electromagnets 50 and 52 are so chosen that they have an extremely short reaction time, lying between 2 and 3 milliseconds per stroke movement. The unit should also be made of light material such as a light metal and may be aluminium. This enables the pressure fluid supplied to the connections 35 and 36 to perform extremely rapid movements of the valve units 25, 26 and 27, so that the unit quickly opens the valve and the opening to the pressure-fluid container 64. The pressure fluid acting upwardly on the impact ram then quickly leaves the pressure surface 6 of the impact ram. This speed is also obtained since the fluid tapped off is able to escape quickly into a space formed in the peripheral groove 23*a*. During the tapping movement the ram unit 25, 26 and 27 will assume its left-hand position. When a stroke has been performed, the ram unit is moved to the right, whereupon the lower contact surface is again placed under pressure. After a stroke the impact ram 2 is returned to its upper position in approximately 15 milliseconds. A stroke frequency of about 3000 strokes/minute can be achieved with the present percussion machine, by allowing the switch 61 to continually change position. The switch can also be arranged so that a number of consecutive strokes is followed by an interval, and then another number of strokes and so on. The switch thus offers infinite possibilities for varying the stroke sequences. The desired kinetic energy is dependent on the oil pressure on the area of the upper contact surface 5, the weight of the striking body and of its stroke length. The energy required is determined by the material to be cut.

Figure 10:
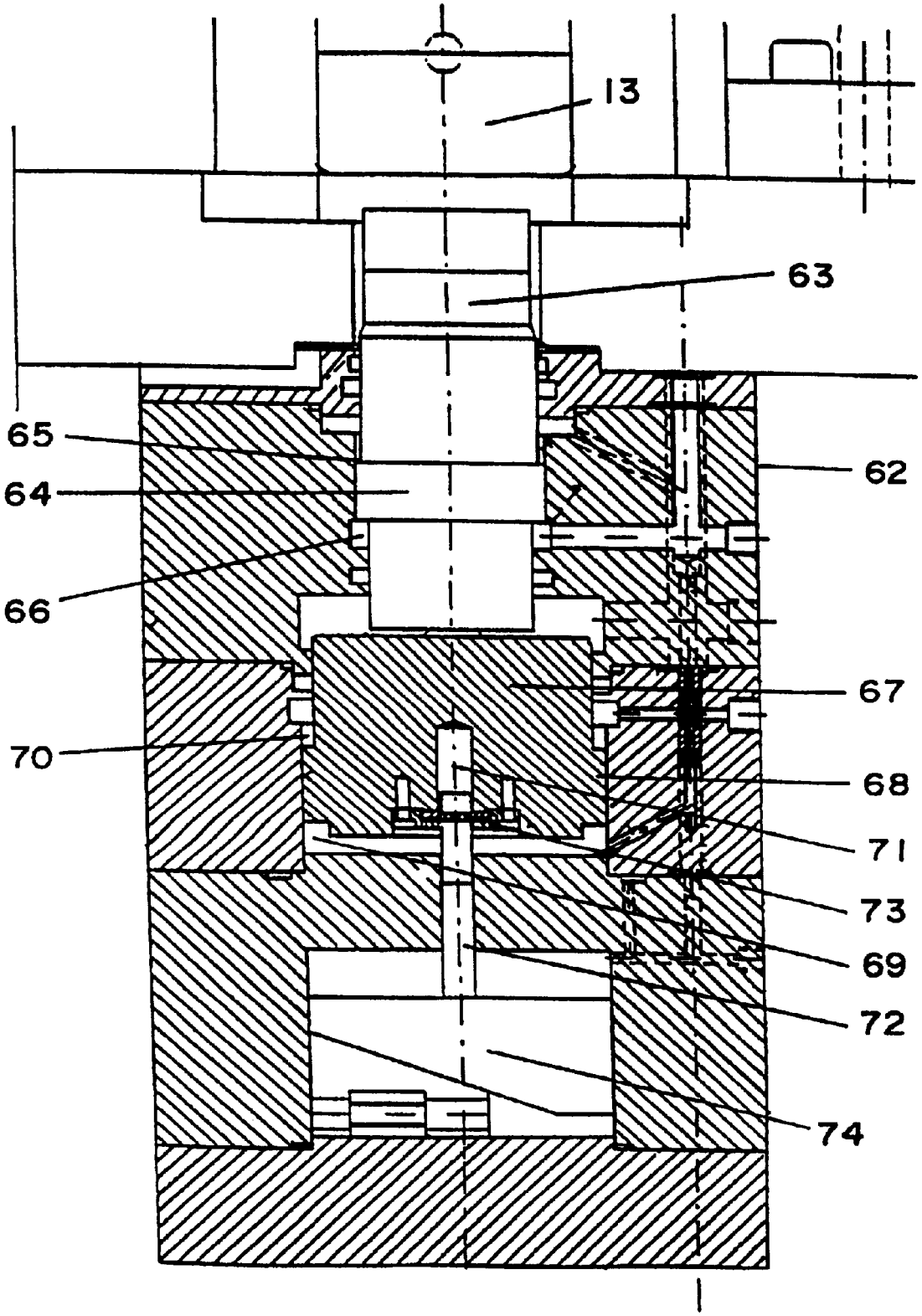
FIG. 10 shows a longitudinal section of a damping unit.
Figure 11:
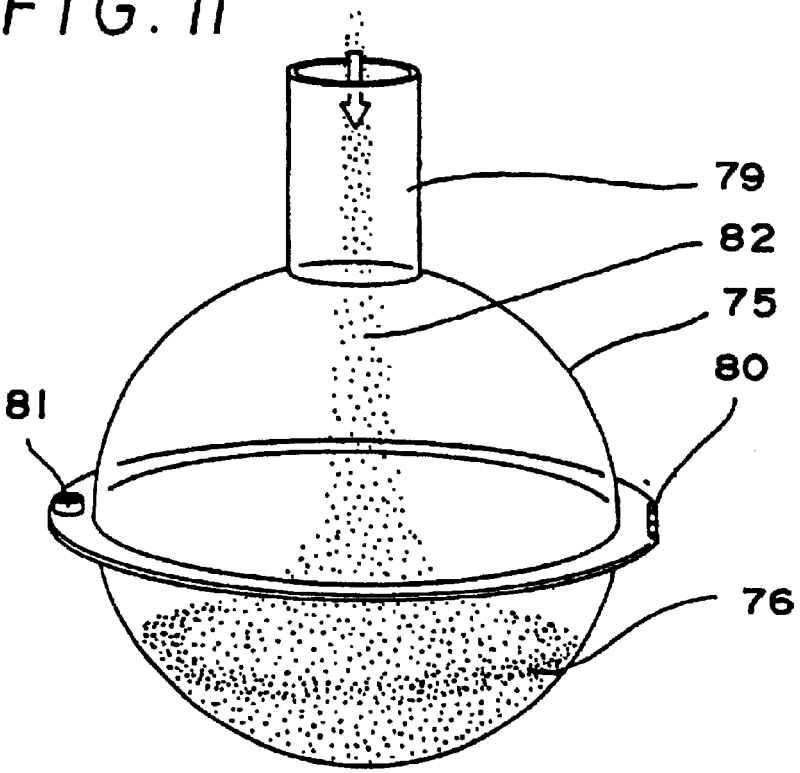
FIG. 11 shows a spherical mould for producing spherical units.
Figure 12:
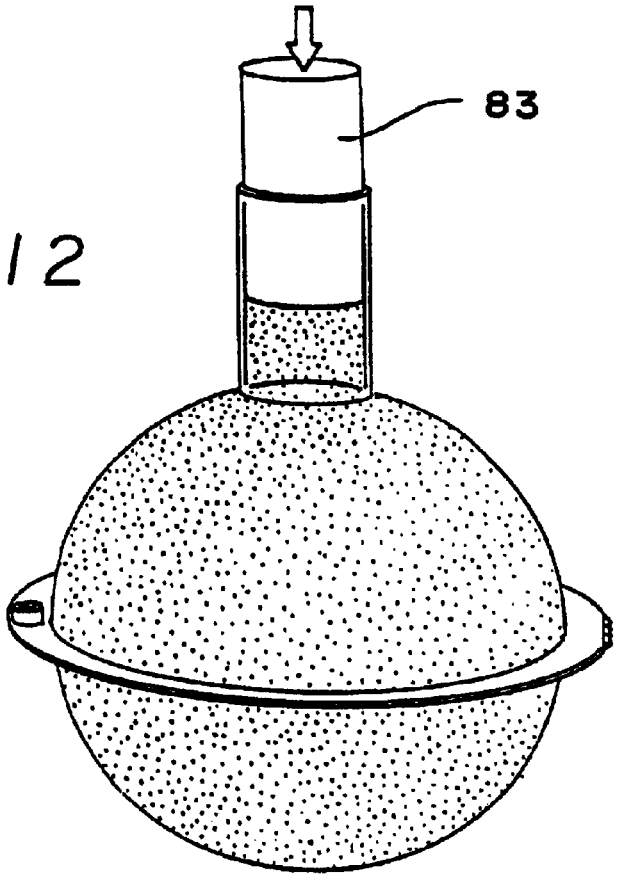
FIG. 12 shows said mould filled with material for producing a sphere and FIG. 13 shows the mould in FIG. 12 opened to reveal the sphere produced.
Figure 13:
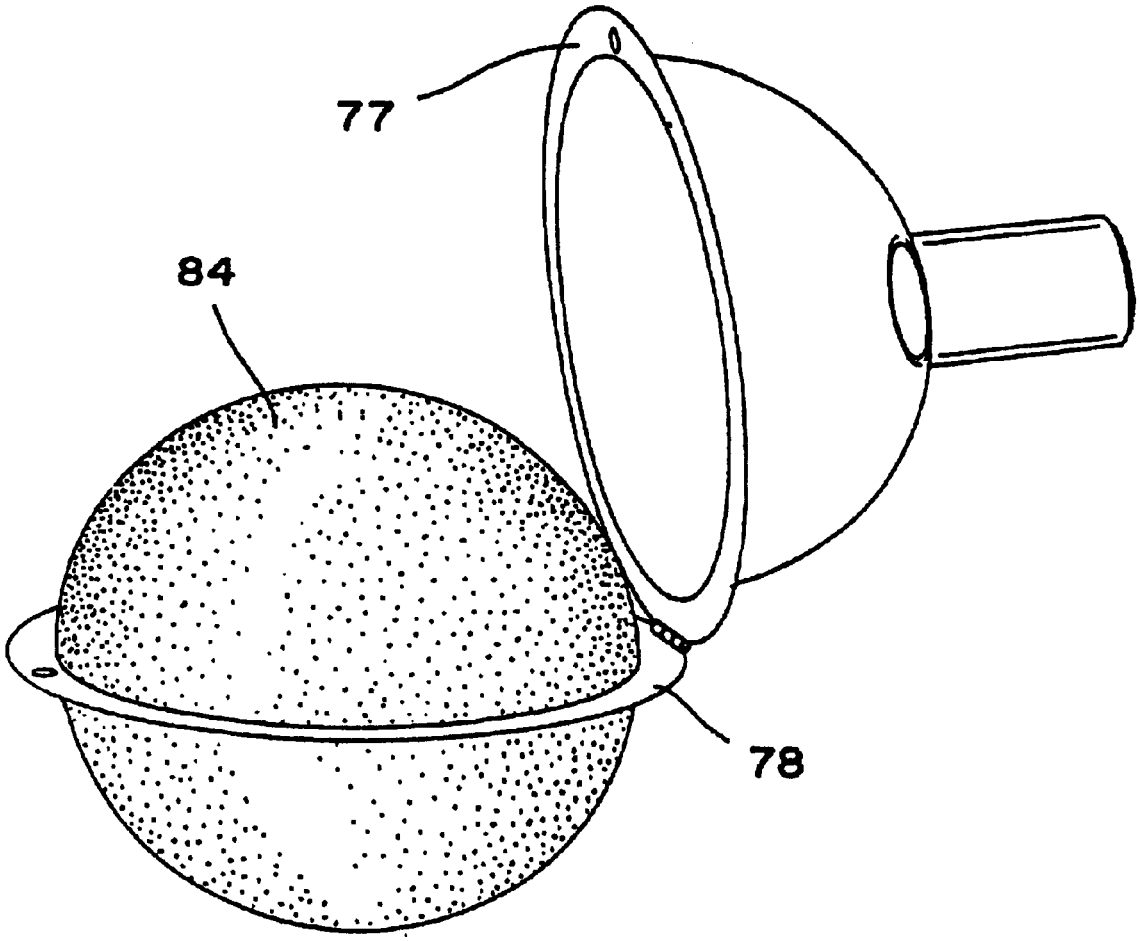

FIG. 10 shows a damping unit 62 with which the impact ram 2 can cooperate. The unit is provided with a ram 63 for returning the tool 13 which is provided with a surrounding band 64 having an upper contact surface for pressure fluid 65 and a lower contact surface 66 for pressure fluid. The transfer ram 63 cooperates with a damping ram 67 having a surrounding band 68 with an upper contact surface 70 for a pressure fluid and a lower contact surface 69 for a pressure fluid. The damping ram 67 has a central aperture 71 leading from its lower end surface. A ram 72 is arranged in this aperture in a predetermined, adjustable position. The rod is attached by its lower end to an adjustable unit 74, vertically movable to a desired position. The unit 74 may be adjusted either manually or automatically. The position of the unit 74 determines the cutting length of the tool 13. A disc 73 with a hole in it, the diameter of which allows passage of the ram 72, is secured in the lower end of the central aperture 71. The thickness of the disc is greater than the width of a peripheral groove of the ram 72, said peripheral groove having an outlet opening for pressure liquid that runs in the centre of the ram 72. The position of the damping ram 67 is fixed by the position of the peripheral groove of the ram 72. Furthermore, the actual damping effect of the damping unit is achieved by means of the oil layer appearing below the damping ram 67.

The percussion machine described has many different applications, such as as an instrument for shaping e.g. for manufacturing spheres or other units to be manufactured in a closed moulding tool.

If spheres are to be produced, for instance, a two-part mould 75 and 76 is used which, when fitted together, defines a spherical space. The mould has a tubular part 79 through which a homogenous material 82 is poured and which is also used for control of the rod 83 inserted into the tubular part 79 and subjected to impact from the percussion machine in order to influence the material enclosed in the spherical mould. Such a mould is filled completely with material from the substance in the sphere and the tubular part. Another suitable material with which to fill the mould is metal powder and in this case, the powder inserted can be compacted the percussion machine to a density of 94–99% of the corresponding density of homogenous material. The compacting should be performed in several steps, e.g. three. If three steps or three strokes are used they must be performed extremely quickly. Each stroke has a specific function as described below:

Stroke 1 an extremely light stroke which forces out most of the air from the powder 82 and orients the powder particles to ensure that there are no great irregularities.

Stroke 2 a stroke with very high energy density and high impact velocity, for local adiabatic coalescence of the powder particles so that they are compressed against each other to extremely high density. The local temperature increase of each powder particle is dependent on the degree of deformation during the stroke.

Stroke 3 a stroke with medium-high energy and with high contact energy for final shaping of the substantially compact material body 84.

The treated body 84 obtained can then be sintered under normal atmospheric pressure.

Thanks to the two-part mould described above it is now possible to achieve compacting of spherical, gas-atomized powder, which has previously been impossible.

Besides forming of gas-atomized powder in a spherical void, a suitably shaped tool space can also be successfully filled with solid material, or material in the form of powder, pellets or similar. The material should preferably be composed of metals and alloys but can also, for example, be made up from non-metallic materials such as ceramic, polymers, woods and composites or mixtures of these.

The forming space is so shaped that it can produce symmetrical and asymmetrical pieces which can have one or more voids. A void can be created by inserting a core (preferably manoeuvrable) in the forming space during the forming process and then withdrawing it as the formed piece is taken from the forming space.

For the finished piece to have different properties in different parts of its body, materials with different properties (e.g. hardness, porosity, magnetism, etc.) can be used in the forming process.

Prior to final forming, the material can be pre-compacted and/or preheated so that the finished piece has the desired properties.

When the impact device hits the tool unit, kinetic energy is generated in the piece to be formed and, simultaneously, the impact unit and the tool are compressed by the force of the impact. The impact mechanism imparts a constant force to the impact unit. This presses down on the tool unit. An opposing force, predominantly generated by expansion in the impact and tool units, overpowers the impact mechanism's constant force and the impact unit thus bounces against the tool unit in a decaying sequence of impacts.

In addition, every impact generates decaying, forward and return, low amplitude, high frequency waves in the piece being formed. The time between amplitude peaks for non-solid materials is influenced by, amongst other things, the real-time density of the piece being formed. Throughout the forming process, density steadily increases as the height of the piece decreases. This contributes to reducing the time between amplitude peaks.

The impact unit can, via a logic unit, be programmed to give one or several impacts in a sequence. The impact energy of the individual impacts can be totalled so that the energy transferred by an impact sequence is referable to that transferred by a single impact.

The design of the impact device and accompanying logic unit allows for the adjustment of the time between impacts in an impact sequence so that an energy peak in the forward and return waves can be superimposed on an energy peak belonging to the subsequent impact.

On completion of the forming process, the piece is pressed out of the tool unit. The piece winnow expand slightly, the degree of expansion corresponding to the pressure exerted by the compressed piece on the tool. The degree of expansion is normally directly related to the density of the compacted piece. To ensure that the piece is not damaged in removing it from the tool unit, a counter force is applied to the piece while it is being freed from the tool unit.

If sintering is to be carried out, the formed piece can, where it is necessary to achieve the best results, be heat treated and re-compacted (in one or several stages) so that air, lubricants and similar residues are expelled.

A rammer which transfers kinetic energy to a tool unit is a suitable design of impact mechanism and impact device. The impact device can also be fixed to the tool unit so that the impact mechanism constitutes an integrated unit. A further possibility is to mount two opposing impact devices in the same machine frame so that the effect the impacts have on the machine's base and bed are minimized.

Impact devices can be powered by hydraulics, electricity, electromagnetism or combinations of these. They can also be mechanical or pneumatic.

When it strikes the tool unit, the impact device should preferably be travelling at a speed considerably in excess of 2 m/s. Speed should be adjustable so that, in the forming of the piece, forces can be optimized. The impact device should be so designed that it can attain a speed (preferably approx. 100 m/s) commensurate with that technically possible with the type of drive being used.

The energy transferred to the tool unit is primarily regulated by adjusting the travel of the impact device. The mass of the impact device's moving parts can be adjusted by providing the device with voids which can be filled with weights when required.

I claim:

1. A method of forming an article through adiabatic coalescence comprising the steps of:

providing a mold;

filling the mold with a material;

placing a tool in the mold that extends from the mold;

providing a striking unit; and, striking the tool with the striking unit with adequate force to adiabatically coalesce the material.

2. The method of claim 1 wherein the material is particulate.

3. The method of claim 2 wherein the particulate material is metallic.

4. The method of claim 1 wherein the striking unit is an impact ram.

5. The method of claim 2 wherein the particulate material comprises a powder.

6. The method of claim 1 wherein the material is selected from the group consisting of metals, metal alloys, ceramics, polymers and woods.

7. The method of claim 1 wherein the step of filling the mold with a material comprises the steps of partially filling the mold with a material, adding at least one core to the mold and adding additional material to the mold to fill the mold.

8. The method of claim 7 including the additional step of removing the core from the mold after striking the tool with the striking unit with adequate force to adiabatically coalesce the material.

9. The method of claim 1 wherein the material comprises one or more different materials.

10. The method of claim 1 wherein the step of filling the mold with a material comprises the steps of filling a first portion of the mold with a first material and filling a second portion of the mold with second material.

11. The method of claim 1 including the additional step of either pre-compacting or preheating the material before striking the mold or material.

12. The method of claim 1 wherein the step of striking the tool with the striking unit with adequate force to adiabatically coalesce the material comprises the step of striking the tool with a first primary impact and plurality of secondary impacts of decreasing force.

13. The method of claim 12 wherein the primary impact generates at least one wave in the material and wherein the timing of the secondary impacts is based on the location of said wave.

14. The method of claim 12 wherein the total energy imparted by said primary impact and said secondary impacts is equal to a predetermined amount.

15. The method of claim 13 wherein the timing of the secondary impacts is selected to generate secondary waves having peaks that correspond to the peaks of the wave generated by the primary impact.

16. The method of claim 1 including the additional step of applying a force to the material to remove it from the mold after the material has been adiabatically coalesced.

17. The method of claim 1 including the additional steps of removing the adiabatically coalesced material from the mold, heat treating the adiabatically coalesced material, returning the adiabatically coalesced material to the mold, and striking the tool with the striking unit.

18. A method of forming an article through adiabatic coalescence comprising the steps of: providing a mold; filling the mold with a material; and, providing a striking unit; striking the mold or the material with the striking unit with adequate force to adiabatically coalesce the material.

* * * * *